United States Patent [19]

Asano et al.

[11] 4,389,128

[45] Jun. 21, 1983

[54] PRINT HEAD FOR A DOT MATRIX PRINTER

[75] Inventors: Kiyomitsu Asano, Musashino; Toshikatsu Kondo; Atsuo Sakaida, both of Nagoya, all of Japan

[73] Assignees: Brother Kogyo Kabushiki Kaisha, Aichi; Nippon Telecommunication Engineering Company, Tokyo, both of Japan

[21] Appl. No.: 290,299

[22] Filed: Aug. 5, 1981

[30] Foreign Application Priority Data

Aug. 14, 1980 [JP] Japan ..... 55-115284[U]

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,009,772 | 3/1977 | Glaser et al. | 400/124 |
| 4,225,250 | 9/1980 | Wagner et al. | 400/124 |
| 4,300,845 | 11/1981 | Martin et al. | 400/124 |

*Primary Examiner*—Paul T. Sewell

*Attorney, Agent, or Firm*—Browdy and Neimark

[57] ABSTRACT

A print head for use in a dot-matrix printer consisting of a plurality of print wires, a guide member with a nose portion for guiding the print wires, a plurality of armatures, an armature support member for supporting one end of the armatures corresponding to each of the print wires, and an armature drive device having a magnetic member with electromagnets respectively corresponding to the armatures. The guide member, the armature support member and the magnetic member are firmly connected in that order by a hollow cylindrical connecting member which fits on the connected members from the side of the last member. The front end of the connecting member is secured by laser welding or the like to the periphery of the guide member, and a plurality of resilient tongues formed on the rear end thereof are engaged with the magnetic member to bias the magnetic member and the armature support member toward the guide member. On the external periphery of each of those members, a pair of positioning shoulders are respectively formed, and on the connecting member a pair of slits are formed. By aligning those shoulders and slits, correct relative positioning of all the members can be easily performed.

7 Claims, 3 Drawing Figures

PRINT HEAD FOR A DOT MATRIX PRINTER

BACKGROUND OF THE INVENTION

1. Field of Technology

This invention relates to a print head for use in a dot-matrix printer.

2. Prior Art

A print head for a dot-matrix printer is composed of a plurality of units, such as an armature-support unit wherein a number of armatures with a print wire fixed thereto are supported by a support member, an armature drive unit including a magnetic member with a number of electromagnets respectively corresponding to each armature for selectively driving the armatures, and a guide unit guiding the print wire of each armature as far as the close vicinity of the printing position. Relative positioning of the units as well as mutual connecting thereof have conventionally been conducted by a pair of through-bores formed in each of those units for the double purpose of mutual positioning and connecting, with the aid of a bolt pierced through the through-bores for fastening the units together.

The through-bores need proper space therefor, tend to make the print head itself large in size, and disturb the formation of the magnetic path or circuit.

SUMMARY OF THE INVENTION

It is a primary object of this invention to provide a print head for a dot-matrix printer extremely which is easy in its assembling or setting up operation.

It is another object of this invention to provide a print head for a dot-matrix printer which is highly compact as well as easy to assemble.

To attain the above objects the invention is applied to a print head including (a) a plurality of print wires, (b) a guide member having a nose portion for guiding said print wires, (c) a plurality of armatures, (d) an armature support member for supporting each one end of said armatures respectively corresponding to each of said print wires, and (e) an electromagnetic armature drive device including a magnetic member with electromagnets correspondingly arranged for each of said armatures. The print head is characterized in that each of the outer constituent members, said guide member, said armature support member and said magnetic member, is respectively provided with a pair of positioning shoulders formed in parallel to the axis of said print head, and that mutual relative positioning of said constituent members when said print head is assembled can be performed by means of aligning the positioning shoulders of all said constituent members mutually. Each of the outer constituent members of the print head, i.e., the guide member, the armature support member and the magnetic member, is respectively provided with a pair of positioning shoulders formed in parallel to the axis of the print head. By aligning the positioning shoulders of all the constituent members, mutually relative positioning of those members can be easily performed.

In a preferred embodiment of this invention, the guide member, the armature support member and the magnetic member are firmly connected by a connecting member. The connecting member may be a hollow cylindrical member which fits on those members. The front end of the connecting member is secured to the guide member by means of laser welding, and an engaging portion formed at the rear end thereof is engaged with the magnetic member. In this case the connecting member is provided with a pair of slits extending from the front end thereof parallel to its axis in correspondence to the positioning shoulders of the members fitted into the connecting member. The engaging portion preferably consists of a plurality of radially inwardly extending resilient tongues for biasing the magnetic member and the armature support member toward the guide member.

The above-mentioned positioning shoulders may be utilized to position the print head on the carriage of the printer. In other words, the lower portion of the print head is inserted into a support opening formed in the carriage and the positioning shoulders are engaged with the opposite edges of the support opening.

The aforementioned connecting member is also effectively used for connecting the magnetic member, the armature support member and the guide member which are not provided with the positioning shoulders.

DETAILED DESCRIPTION OF A PREFERRED EMBODIMENT

With reference to the appended drawings, a preferred embodiment of this invention will now be described.

Figure 3:
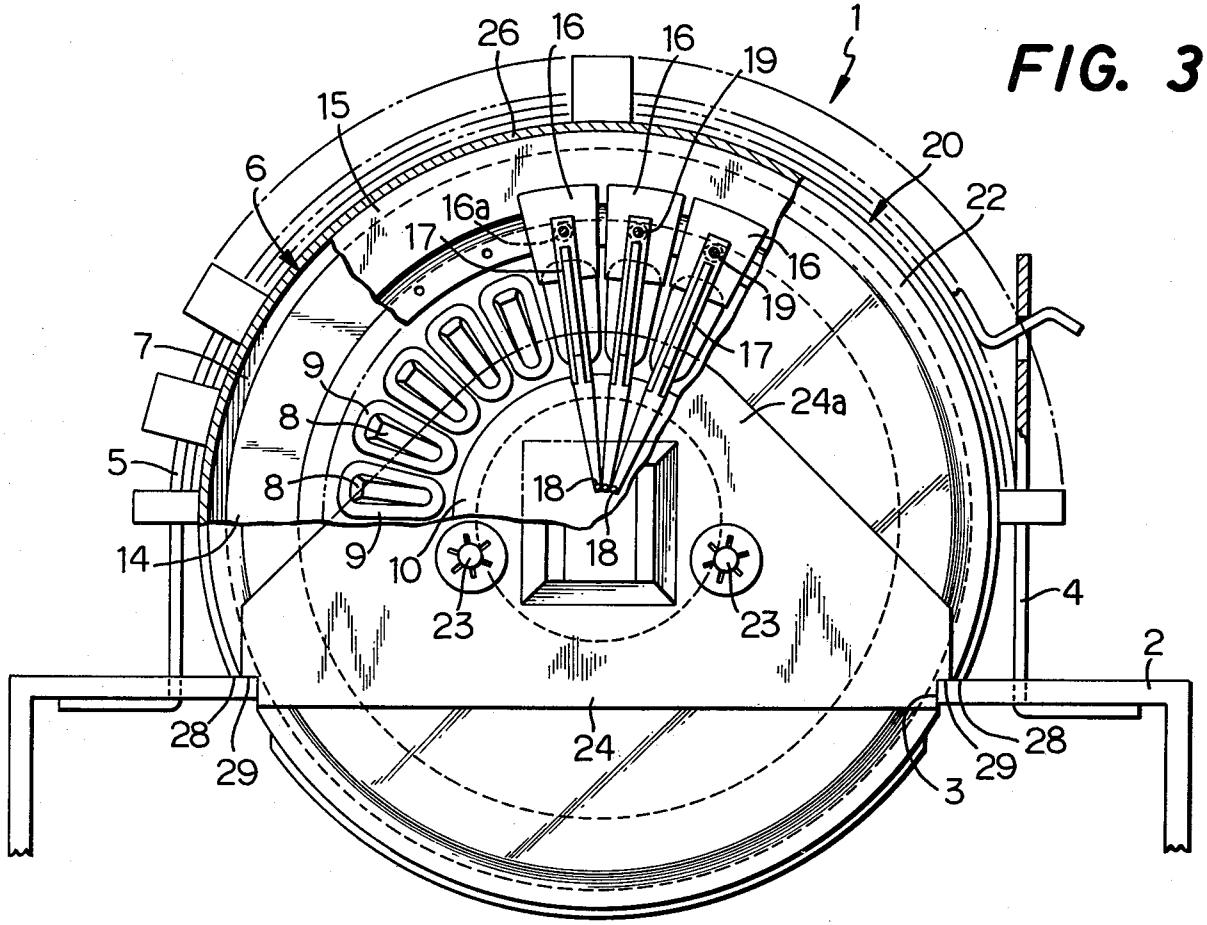
FIG. 3 is an elevational view, partly broken away, of the print head of FIG. 1 shown attached to the carriage.

A print head 1 in this embodiment is, while being fitted into a support opening 3 bored in a carriage 2 of a printer, secured as shown in FIG. 3 in a fastened state by a lock plate 4 retained by the carriage 2 and a fastening belt 5 wound around the periphery thereof.

Figure 1:
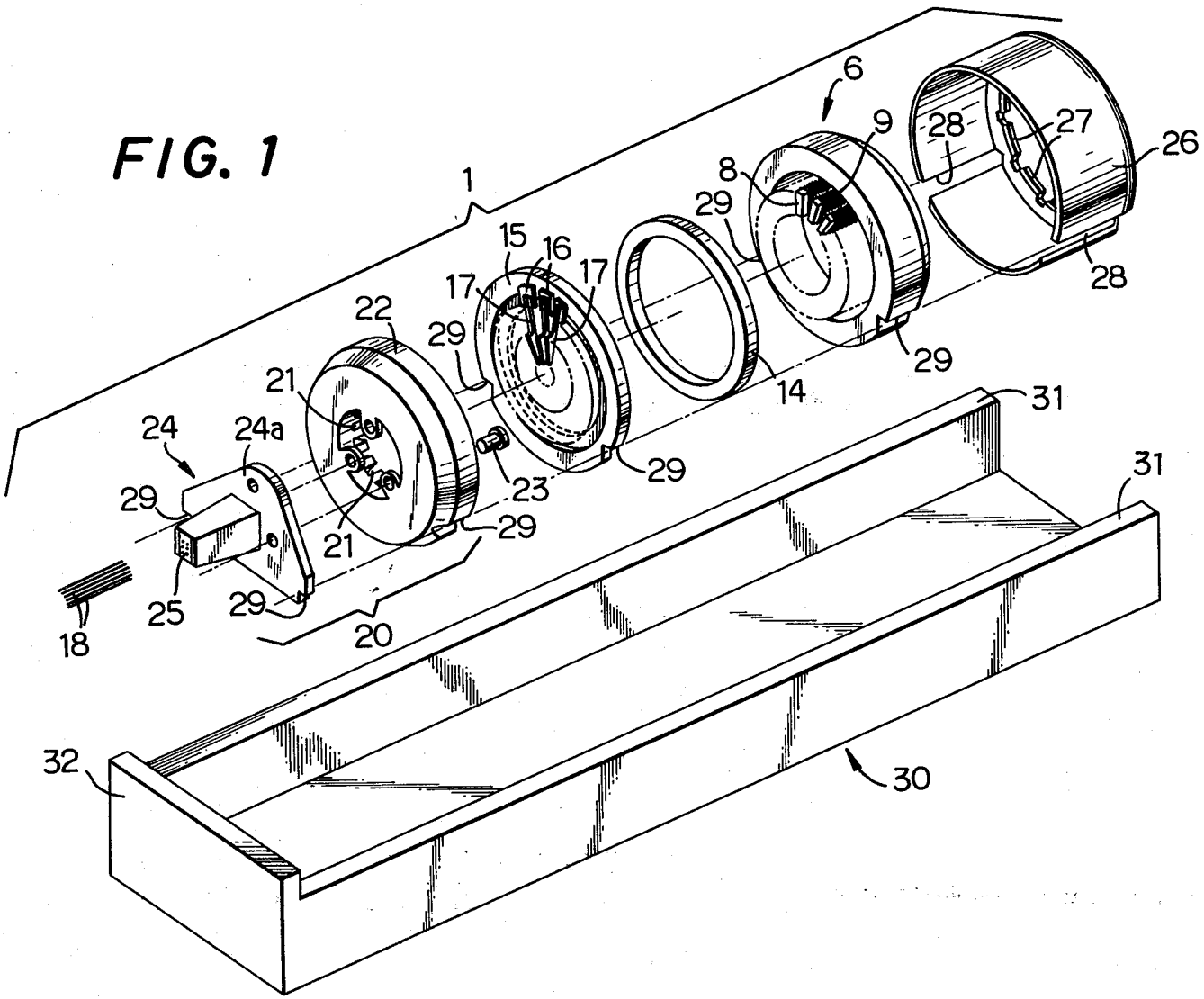
FIG. 1 is an exploded perspective view of a print head embodying this invention and an assembling tool therefor.
Figure 2:
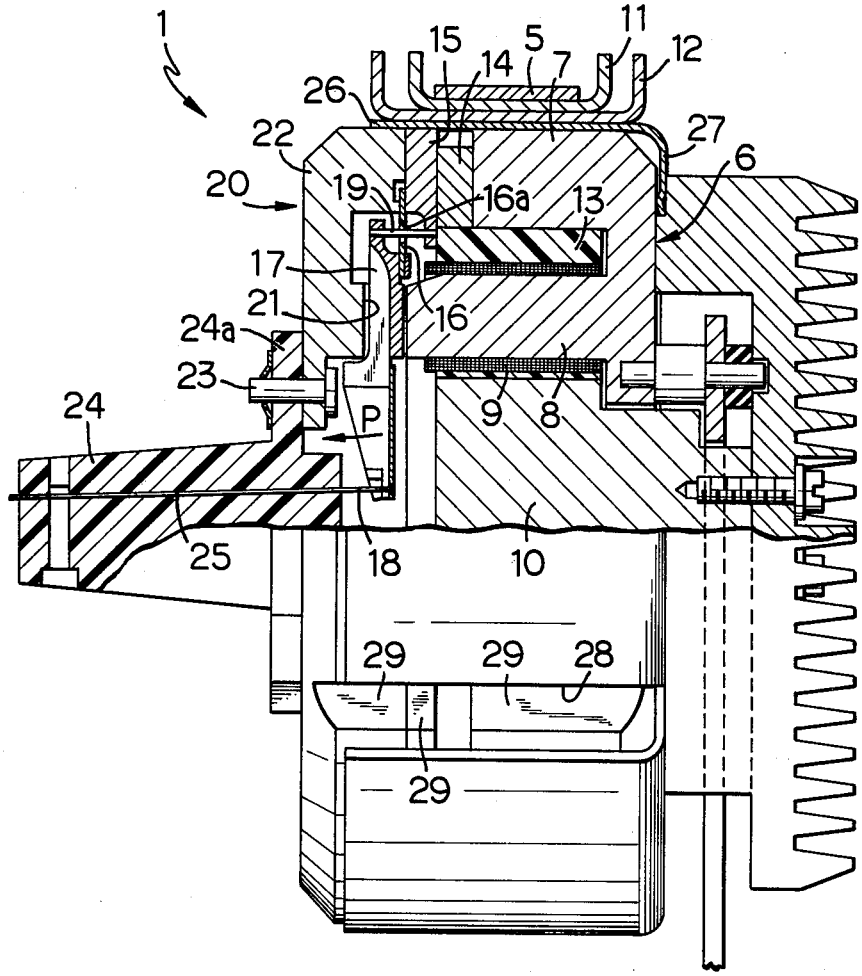
FIG. 2 is a side view, partly broken away, of the print head of FIG. 1.

Structure of the print head 1 will be described next with reference to FIGS. 1 and 2. A magnetic member 6 of annular shape disposed at the back of the print head 1 consists of an annular yoke portion 7 and a plurality of cores 8 arranged inside the yoke. About each of the cores 8 a coil 9 is wound to form an electromagnet. In the central area of the magnetic member 6 a heat sink member 10 is disposed and fins 11, 12 are disposed between the magnetic member 6 and the fastening belt 5 to dissipate the heat generated. An annular permanent magnet 14 is fixed to the front surface of the yoke portion 7. Synthetic resin 13 of good heat conductivity fills the space around the heat sink member 10 in the central area, the coil 9, and the yoke portion accompanied by the permanent magnet 14 as shown in FIG. 2.

On the front surface of the permanent magnet 14 there is fixed an annular support member 15 made of a magnetic material for supporting armatures 17. On the front surface of the support member 15 leaf spring 16 are fixed at one end thereof so that they face cores 8 respectively. On each other end of the leaf spring 16 each of the armatures 17 is fixed at its foot. On each free end portion of the armature 17 a print wire 18 is respectively fixed. The ends of a wire spring 19 which extends perpendicularly through an aperture **16*a* bored in the leaf spring 16, are fixed to the foot of the armature 17 at one end thereof and to the inner rim of the support member 15 at the other end thereof. The support member 15, the armatures 17, the leaf springs 16 and the wire springs 19** constitute an armature support device or unit.

Each of the armatures 17 is normally attracted by the magnetic force of the permanent magnet 14 to the end surface of the core 8 against the spring force of the leaf spring 16 and the wire spring 19. When the coil 9 is energized by current conduction a magnetic flux of a direction opposite to that of the magnetic flux in the permanent magnet 14 is generated in the core 8 corresponding to the energized coil 9. This magnetic flux neutralizes the magnetic force of the permanent magnet 14 so as to make an armature 17 corresponding to the particular core 8 activated to be moved in the direction of arrow P due to the spring force of the leaf spring 16 as shown in FIG. 2. This movement of the armature 17 causes the print wire 18 to perform a printing operation. The core 8 and the coil 9 constitute an electromagnet corresponding to each of the armatures 17. The permanent magnet 14 and the magnetic member 6 incorporating this electromagnet constitute an electromagnetic armature drive device or unit. The armature drive device and the aforementioned armature support device constitute a print wire drive device.

The front portion of the print head 1 comprises a guide unit 20, which consists of a cover member 22 having a number of notches 21, one for each of the armatures 17, and a nose member 24 secured to the central portion of the cover member 22 by pin means 23. A plurality of guide apertures 25, one for each of the print wires 18, are formed in nose member 24.

The magnetic member 6, the permanent magnet 14, the support member 15, and the cover member 22, are fitted in from the rear side and are protectively connected by a connecting member 26 of hollow cylinder shape. The front end of the connecting member 26 is secured to the external periphery of the cover member 22 by means of laser beam welding or the like. The rear end of the connecting member 26 has a number of integral resilient tongues 27 which extend radially inwardly and are circumferentially equally spaced. Tongues 27 abut the rear end of the magnetic member 6 at its peripheral portion. The armature drive device is thereby biased toward the guide member 20 assuring a firm connection between the two. The earlier mentioned fastening belt 5, is by way of the fin 12, wound around the periphery of the connecting member 26. In a lower portion of the connecting member 26 a pair of slits 28 are formed parallel to the axis thereof. Plate portion **24*a* of the nose member 24, the cover member 22, the support member 15, and the magnetic member 6, are each formed with a pair of peripheral positioning shoulders 29, made by notching parallel to the axis of the print head 1, and all aligned with the pair of slits 28. The positioning shoulder 29** on each of those members are respectively formed in full consideration of possible mutual alignment or re-alignment when they are later assembled or re-assembled.

The slits 28 and the positioning shoulders 29 are so designed as to be engaged with rail portions 31 of a tool 30 for assembling the print head 1, to position the guide member 20, the support member 15, and the magnetic member 6 at their proper places relative to each other about the axis of head 1.

The slits 28 and the positioning shoulders 29 are, when the print head 1 is partly fitted into or accommodate in the support opening 31 of the carriage 2, engaged with the opposite side edges of a portion defining the support opening 3 so as to circumferentially position the print head 1 with respect to the carriage 2.

The permanent magnet 14 has, on the other hand, a slightly smaller diameter than the magnetic member 6, so that it does not contact the rail portions 31 of the tool 30 or the side edges of the support opening 3, when the slits 28 and the positioning shoulders 29 are in engagement therewith.

The front end of the tool 30 is provided with a positioning plate 32 for restricting the forwardmost position of the plate portion **24*a* of the nose member 24 when the print head 1 is assembled or set up by utilizing the tool 30**.

The assembling process of the print head 1 will now be described. Into each of the guide apertures 25 of the guide unit 20, which is an integrated body of a nose member 24 and the cover member 22, the print wire 18 is respectively inserted. The guide unit 20 is then placed, together with the support member 15 including the armatures 17 already fixed thereto, upon the tool 30 in such a manner that the positioning shoulders 29 engage with the rail portions 31. The plate portion **24*a* of the nose member 24 must be at this time be exactly regulated with respect to its position by the positioning plate 32. Positioning in rotational direction between the guide unit 20 and the support member 15** is carried out at this stage.

When the support member 15 and the guide member 20 are placed in close contact on the tool 30, the rear end of each of the print wires 18 is respectively firmly welded to the free end portion of each of the armatures 17 by suitable means such as laser beam welding.

After the magnetic member 6 on which the permanent magnet 14 has been integrally fixed and the connecting member 26 are set on the tool 30 so that the positioning shoulders 29 and slits 28 thereof engage the rail portions 31, the magnetic member 6 and the support member 15 are integrated by making good use of the magnetic force of the permanent magnet 14. The support member 15 and the magnetic member 6 as a driving member for the armature 17 are therefore integrated at a predetermined position so that each of the armatures 17 corresponds to a predetermined electromagnet. When such integration has been completed, the connecting member 26 fits onto the integrated unit until the resilient tongues 27 press onto the rear end face of the magnetic member 6. The front end of the connecting member 26 is firmly welded to the external periphery of the cover member 22 by use of a laser beam or like method. Therefore, the armature drive device and the guide unit 20 are firmly fixed together by the biasing force of the resilient tongues 27. The relative positions about the axis of the magnetic member 6, the support unit 15, and the guide member 20 have been fixed by the positioning shoulders 29 and can be maintained with certainty due to the attraction force of the permanent magnet 14 and the biasing force of the resilient tongues 27.

By means of fitting the thus assembled print head 1 into the support opening 3 in the carriage 2, engagement of the positioning shoulders 29 with the opposite edges of the support opening 3, and fastening using the lock plate 4 and the fastening belt 5, the whole structure of the print head 1 can be firmly mounted on the carriage 2 while all of the constituent mmebers thereof are kept in their correct relative positions about the axis of the head 1.

While the invention has been described in detail above, it is to be understood that this detailed description is by way of example only, and the protection granted is to be limited only within the spirit of the invention and the scope of the following claims.

What is claimed is:

1. A print head for a dot-matrix printer comprising:
a plurality of print wires;
a guide member with a nose portion for guiding said print wires;
a plurality of armatures corresponding to said print wires respectively;
an armature support member for supporting said armatures at one end thereof;
an electromagnetic armature drive device having, for selectively driving said armatures, a permanent magnet and a magnetic member;
a pair of positioning shoulders formed in the external periphery of each of said guide member, said armature support member and said magnetic member, said positioning shoulders of all of said members being brought into alignment with one another to establish relative positional alignment of said members when they are assembled together; and
a connecting member fitting on said guide member, said armature support member, said magnetic member to connect them in that order with the aid of said positioning shoulders, one axial end of said connecting member being secured to the external periphery of said guide member, and the other axial end of said connecting member being provided with a plurality of resilient tongues engaging said magnetic member for biasing said magnetic member and said armature support member toward said guide member.

2. A print head as claimed in claim 1, wherein said connecting member is a hollow cylindrical member having a pair of slits formed so as to extend between said one axial end and said other axial end thereof in parallel to its axis, and said pair of slits being aligned with said pair of positioning shoulders.

3. A print head and carriage assembly in a dot-matrix printer comprising:
(1) a print head comprising:
a plurality of print wires;
a guide member with a nose portion for guiding said print wires;
a plurality of armatures corresponding to said print wires, respectively;
an armature support member for supporting said armatures at one end thereof;
an electromagnetic armature drive device having, for selectively driving said armatures, a permanent magnet and a magnetic member;
a pair of positioning shoulders formed in the external periphery of each of said guide member, said armature support member and said magnetic member, said positioning shoulders of all of said members being brought into alignment with one another to establish relative positional alignment of said members when they are assembled together; and
a connecting member fitting on said guide member, said armature support member, and said magnetic member to connect them in that order with the aid of said positioning shoulders, one axial end of said connecting member being secured to the external periphery of said guide member, and the other axial end of said connecting member being provided with a plurality of resilient tongues engaging said magnetic member for biasing said magnetic member and said armature support member toward said guide member,
(2) a carriage having a portion defining a support opening in which a part of said print head is accommodated with said positioning shoulders engaging opposite side edges of said portion defining said support opening, and
(3) means for fastening said print head to said carriage.

4. A print head for a dot-matrix printer including (a) a plurality of print wires, (b) a guide member having a nose portion for guiding said print wires, (c) a plurality of armatures corresponding to said print wires respectively, (d) an armature support member for supporting one end of each of said armatures, and (e) an electromagnetic armature drive device including a magnetic member having electromagnets arranged to correspond to said armatures respectively, wherein the improvement comprises:
alignment means for positioning said guide member, said armature support member and said magnetic member one with respect to another, said alignment means comprising a pair of positioning shoulders defined by notches formed in spaced relation with each other in the periphery of each of said guide, armature support and magnetic members and all in parallel to the axis of said print head, all pairs of said positioning notches being brought into alignment with one another when said guide, armature support and magnetic members are put together into an assembly, whereby correct circumferential positioning of all of said members relative to each other is easily established.

5. A print head for a dot-matrix printer including (a) a plurality of print wires, (b) a guide member having a nose portion for guiding said print wires, (c) a plurality of armatures corresponding to said print wires respectively, (d) an armature support member for supporting one end of each of said armatures, and (e) an electromagnetic armature drive device including a magnetic member having electromagnets arranged to correspond to said armatures respectively, wherein the improvement comprises:
alignment means for positioning said guide member, said armature support member and said magnetic member one with respect to another, said alignment means comprising a pair of positioning shoulders defined by notches formed in spaced relation with each other in the periphery of each of said guide, armature support and magnetic members and in parallel to the axis of said print head, all pairs of said positioning notches being brought into alignment with one another when said guide, armature support and magnetic members are put together into an assembly, whereby correct circumferential positioning of all of said members relative to each other is easily established; and
a carriage having a portion defining a support opening in which a part of said print head is accommodated with said positioning shoulders engaging opposite sides edges of said portion defining said support opening.

6. A print head for a dot-matrix printer comprising:
a plurality of print wires;

a print wire drive device including a plurality of armatures connected to said print wires respectively, and an electromagnetic armature drive unit having a magnetic member for selectively actuating said armatures;

a guide member having a nose portion for guiding said print wires and a cover portion for covering one side of said print wire drive device; and a hollow cylindrical connecting member fitted on said guide member and said magnetic member and connecting said two members, one axial end of said cylindrical connecting member being secured to the external periphery of said guide member and the other axial end thereof having a plurality of circumferentially spaced resilient tongues which extend radially inwardly of said cylindrical connecting member, said resilient tongues engaging one end face of said magnetic member on the other side of said print wire drive device thereby biasing said magnetic member toward said guide member for firm connection of said two members.

7. A print head as claimed in claim 6, wherein said magnetic member includes an annular yoke portion and a plurality of cores arranged inside said yoke portion to correspond to each of said armatures, and said electromagnetic armature drive device further includes a plurality of coils each wound on each of said cores, and an annular permanent magnet sandwiched between said annular yoke portion and said armature support member, whereby a magnetic force of said permanent magnet attracts said magnetic member, said armature support member and said guide member and assists said connecting member in connecting all of said magnetic, armature support and guide members.

* * * * *